US009526330B2

(12) United States Patent
Weijian

(10) Patent No.: US 9,526,330 B2
(45) Date of Patent: Dec. 27, 2016

(54) MODULARIZED PRESENTATION BOARD HAVING IMPROVED STRUCTURE

(71) Applicant: Qian Weijian, Ningbo (CN)

(72) Inventor: Qian Weijian, Ningbo (CN)

( * ) Notice: Subject to any disclaimer, the term of this patent is extended or adjusted under 35 U.S.C. 154(b) by 219 days.

(21) Appl. No.: 14/615,090

(22) Filed: Feb. 5, 2015

(65) Prior Publication Data

US 2016/0071438 A1 Mar. 10, 2016

(30) Foreign Application Priority Data

Sep. 9, 2014 (CN) ..... 2014 2 0521808 U

(51) Int. Cl.

| | |
|---|---|
| ***B43L 1/02*** | (2006.01) |
| ***A47B 47/00*** | (2006.01) |
| ***A47F 5/10*** | (2006.01) |
| *A47B 47/04* | (2006.01) |

(52) U.S. Cl.

CPC ..... *A47B 47/0075* (2013.01); *A47B 47/0033* (2013.01); *A47F 5/105* (2013.01); *A47B 47/042* (2013.01)

(58) Field of Classification Search

USPC ... 434/72, 79, 408, 413, 425, 428, 429, 430; 40/605; 160/135; 52/36.1, 36.5, 312

See application file for complete search history.

(56) References Cited

U.S. PATENT DOCUMENTS 4,128,286 A * 12/1978 Windisch ..... A47F 5/105 211/86.01
4,785,565 A * 11/1988 Kuffner ..... A47F 5/105 160/135
5,671,852 A * 9/1997 Maharg ..... A47F 5/0815 211/182
5,687,859 A * 11/1997 Miller ..... G09F 15/0068 211/182
6,393,782 B1 * 5/2002 Berridge ..... E04C 5/122 52/223.13
6,493,995 B2 * 12/2002 McKenzie ..... A47F 5/105 52/220.7
6,718,709 B2 * 4/2004 Koutras ..... E04B 2/7405 160/135
7,632,103 B2 * 12/2009 Williams ..... B43L 1/06 434/408
8,596,600 B2 * 12/2013 Spencer ..... A47B 97/001 248/447.1
8,955,928 B2 * 2/2015 Cheng ..... A47F 5/0018 220/4.33
9,254,051 B2 * 2/2016 McPhillips ..... G09F 15/00
2002/0092626 A1 * 7/2002 Beall ..... A47G 5/00 160/135

* cited by examiner

*Primary Examiner* — Kurt Fernstrom
(74) *Attorney, Agent, or Firm* — Hamre, Schumann, Mueller & Larson, P.C.

(57) ABSTRACT

A modularized presentation board includes multiple rectangular presentation board modules, multiple plug connectors and multiple articulation pieces; 45-degree chamfer structures are arranged at four corners of each presentation board module, a clamping slot is configured in the middle of each of four corners in the thickness direction, multiple strip-shaped bulges and multiple reinforced ribs perpendicular to the strip-shaped bulges are respectively arranged on both sides of each clamping slot, and a groove is defined between every two adjacent reinforced ribs; and the plug connectors and the articulation pieces are equipped with multiple annular bulges, respectively, and thus nested and matched connection between every two adjacent presentation board modules is realized.

7 Claims, 13 Drawing Sheets

A

MODULARIZED PRESENTATION BOARD HAVING IMPROVED STRUCTURE

TECHNICAL FIELD

The present invention relates to the technical field of presentation boards, in particular to a modularized presentation board having an improved structure.

BACKGROUND

In order to make clients understand products more intuitively, some dealers will present the products on presentation boards; at present, the commercially available presentation boards have complicated structures, poor flexibility and single presentation effect, are inconvenient to disassemble and assemble and are incapable of adapting to demands of market.

SUMMARY

The present invention aims at providing a modularized presentation board having an improved structure, which is simple in structure, good in flexibility and convenient to assemble and transport and can be assembled into different styles of presentation effects.

In order to solve said problems in the background art, the present invention adopts the following technical solution:

The present invention provides a modularized presentation board having an improved structure, which comprises multiple presentation board modules, multiple plug connectors and multiple articulation pieces and is characterized in that the presentation board modules are rectangular and 45-degree chamfer structures are arranged on four corners of each presentation board module; a clamping slot is configured in the middle of each of four corners in the thickness direction, multiple strip-shaped bulges and multiple reinforced ribs perpendicular to the strip-shaped bulges are respectively arranged on both sides of each clamping slot, and a groove is defined between every two adjacent reinforced ribs; the plug connectors and the articulation pieces are equipped with multiple annular bulges, respectively, and multiple strip-shaped grooves are symmetrically formed in the upper side and the lower side and/or the left side and the right side of each plug connector; the strip-shaped grooves and the strip-shaped bulges on the clamping slot of the corresponding presentation board module are mutually nested and matched, and therefore the nested and matched connection between every two adjacent presentation board modules is realized.

In the present invention, the plug connectors include a first plug connector, a second plug connector, a third plug connector, a fourth plug connector, a fifth plug connector, a sixth plug connector, a seventh plug connector, an eighth plug connector, a ninth plug connector, a tenth plug connector, an eleventh plug connector, a twelfth plug connector and a thirteenth plug connector; and the articulation pieces include a first articulation piece, a second articulation piece and a third articulation piece.

In the present invention, an annular bulge and two or four strip-shaped grooves symmetric up and down are respectively configured on each plane of the flat plug connectors and articulation pieces, and the annular bulges on the front plane and the back plane of each plug connector are mutually symmetric, which is conductive to manual operation of workers to the plug connectors.

In the present invention, hinges are arranged in the annular bulges on each articulation piece, extend to the upper end surface and the lower end surface of the articulation piece and are configured to realize mutual connection between every two adjacent presentation board modules at any angle.

In the present invention, a support upright or roller is also arranged in the middle of the lower part of each of the third plug connector, the sixth plug connector, the eighth plug connector, the eleventh plug connector and the third articulation piece, so that the presentation board can locally or integrally move after being mounted.

In the present invention, multiple mutually parallel strip-shaped elongated slots are formed in each rectangular presentation board module.

In the present invention, horizontal and vertical symmetric strip-shaped grooves are formed in each of the seventh plug connector, the ninth plug connector, the tenth plug connector and the eleventh plug connector.

The present invention has the following beneficial effects that: various connecting components of the product are simple in structure, convenient to assemble, disassemble and transport and good in flexibility and can be assembled into various presentation boards or desks novel in style.

BRIEF DESCRIPTION OF THE DRAWINGS

Accompanying drawings that need to be used in description of the embodiments or the existing technology will be briefly introduced below in order to illustrate the embodiments of the present invention and the technical solution of the existing technology, and it is apparent for those common skilled in the art that the accompanying drawings described as below are just some embodiments of the present invention and other accompanying drawings can be acquired on the basis of those accompany drawings on the premise of not paying creative work.

DETAILED DESCRIPTION

Figure 1:
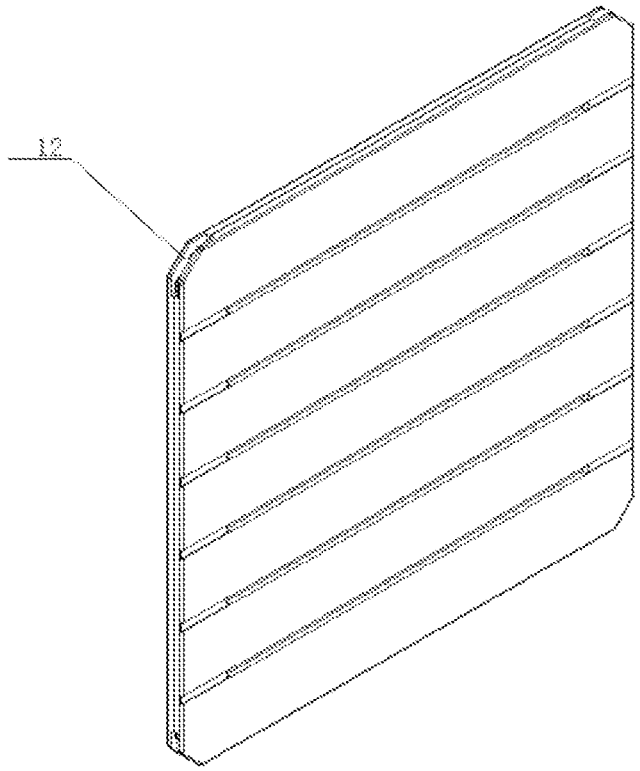
FIG. 1 is a structural schematic diagram of the presentation board modules in the present invention.
Figure 2:
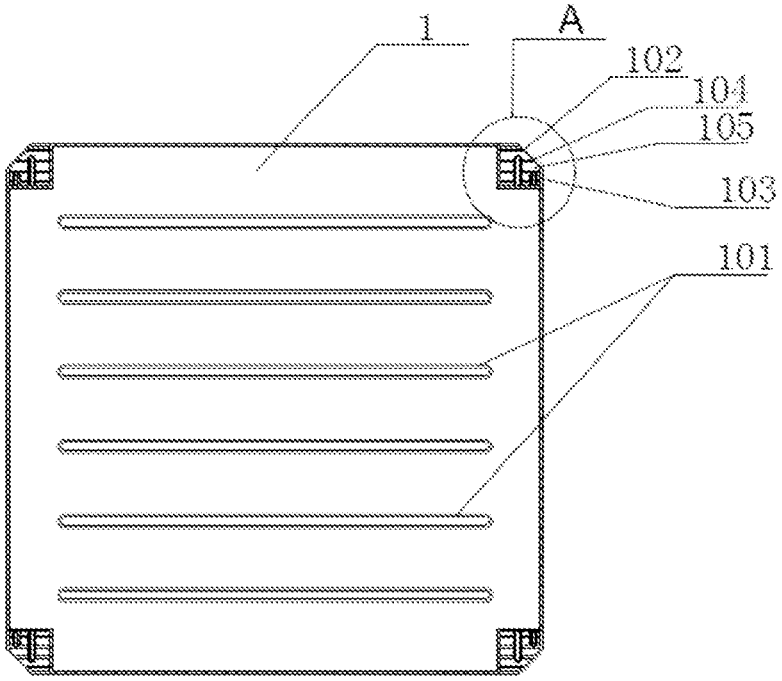
FIG. 2 is a section diagram of the presentation board modules in the present invention.

The following embodiments can help the skilled in the art of this professional technical field understand the present invention more completely but do not limit the present invention in any form.

As shown in FIGS. 1 to 25, the specific embodiment of the modularized presentation board having the improved structure comprises multiple presentation board modules 1, multiple plug connectors (2, 4, 5, 8, 9, 10, 11, 12, 13, 14, 15, 16 and 18) and multiple articulation pieces (3, 6 and 7); Each rectangular presentation board module 1 is equipped with multiple mutually parallel strip-shaped elongated slots 101, and 45-degree chamfer structures are arranged on four corners of each presentation board module 1; a clamping slot 102 is configured in the middle of each of the four corners in the thickness direction, two strip-shaped bulges 103 and four reinforced ribs 104 perpendicular to the strip-shaped bulges 103 are arranged on both sides of each clamping slot 102, and a groove 105 is defined between every two adjacent reinforced ribs 104; the plug connectors (2, 4, 5, 8, 9, 10, 11, 12, 13, 14, 15, 16 and 18) and the articulation pieces (3, 6 and 7) are provided with 2 to 4 annular bulges, respectively, four to sixteen strip-shaped grooves are symmetrically configured in the front side and the rear side, the upper side and the lower side and/or the left side and the right side of each of the plug connectors (2, 4, 5, 8, 9, 10, 11, 12, 13, 14, 15, 16 and 18), and said the strip-shaped grooves and the strip-shaped bulges 103 on the clamping slots 102 of the presentation board modules 1 are mutually nested and matched, and thus the nested and matched connection between every two adjacent presentation modules 1 is realized.

Wherein, the plug connectors include the first plug connector 2, the second plug connector 4, the third plug connector 5, the fourth plug connector 8, the fifth plug connector 9, the sixth plug connector 10, the seventh plug connector 11, the eighth plug connector 12, the ninth plug connector 13, the tenth plug connector 14, the eleventh plug connector 15, the twelfth plug connector 16 and the thirteenth plug connector 18, and the articulation pieces include the first articulation piece 3, the second articulation piece 6 and the third articulation piece 7.

Each plane of the flat plug connectors (2, 5, 8, 11, 12, 13, 14, 15, 16 and 18) and the articulation pieces (3 and 7) is provided with one annular bulge and two or four strip-shaped grooves symmetric up and down, respectively.

The annular bulges on the front plane and the back plane of each of the plug connectors (2, 4, 5, 8, 9, 10, 11, 12, 13, 14, 15, 16 and 18) are mutually symmetric, which is conductive to the manual operation of workers to the plug connectors.

Figure 4:
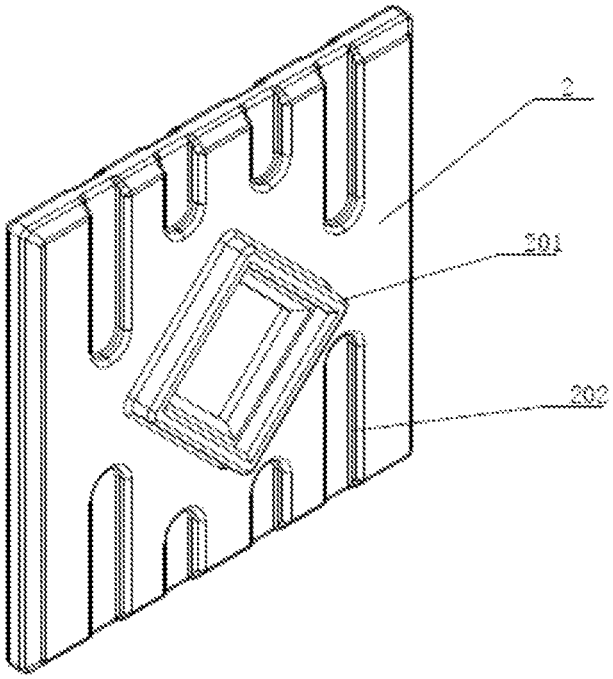
FIG. 4 is a structural schematic diagram of the first plug connector in the present invention.

As shown in FIG. 4, the first plug connector 2 comprises two annular bulges 201 and sixteen strip-shaped grooves 202 on the front plane and the back plane, wherein the annular bulges 201 are positioned in the middle of the first plug connector 2 and are mutually symmetric front and back, and the strip-shaped grooves 202 in the upper end and the lower end of the first plug connector 2 are symmetric front and back, up and down as well as left and right, respectively.

Figure 6:
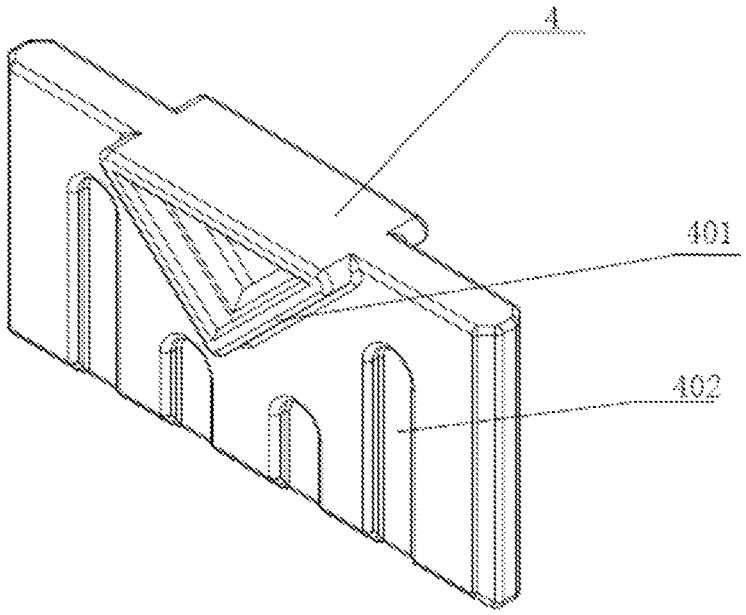
FIG. 6 is a structural schematic diagram of the second plug connector in the present invention.

As shown in FIG. 6, the second plug connector 4 comprises two annular bulges 401 and eight strip-shaped grooves 402 on the front plane and the back plane, wherein the annular bulges 401 are positioned in the middle of the top end of the second plug connector 2, and the strip-shaped grooves 402 in the lower end of the second plug connector 4 are symmetric front and back as well as left and right, respectively.

Figure 8:
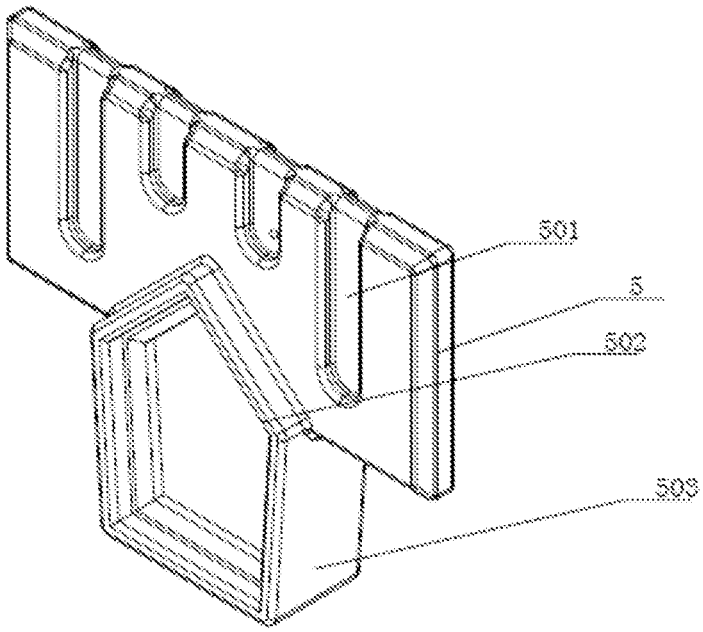
FIG. 8 is a structural schematic diagram of the third plug connector in the present invention.

As shown in FIG. 8, the third plug connector 5 comprises two annular bulges 502 and eight strip-shaped grooves 501, wherein the annular bulges 502 are positioned in the middle of the lower end of the third plug connector 5, and the strip-shaped grooves 501 in the upper end of the third plug connector 5 are symmetric front and back as well as left and right, respectively; the support upright 503 is also arranged in the middle of the lower end of the third plug connector 5 and is configured to support the corresponding presentation board module 1. Furthermore, the support upright 503 in the middle of the lower end of the third plug connector 5 can also be changed into the roller structure.

Figure 10:
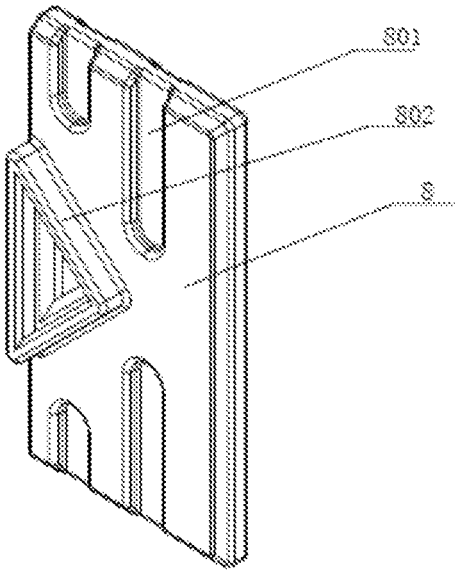
FIG. 10 is a structural schematic diagram of the fourth plug connector in the present invention.

As shown in FIG. 10, the fourth plug connector 8 comprises two annular bulges 802 and eight strip-shaped grooves 801 on the front plane and the back plane, wherein the annular bulges 802 are positioned in the middle of the side surface of the fourth plug connector 8, and the strip-shaped grooves 801 in the upper end and the lower end of the fourth plug connector 8 are symmetric front and back as well as up and down, respectively.

Figure 11:
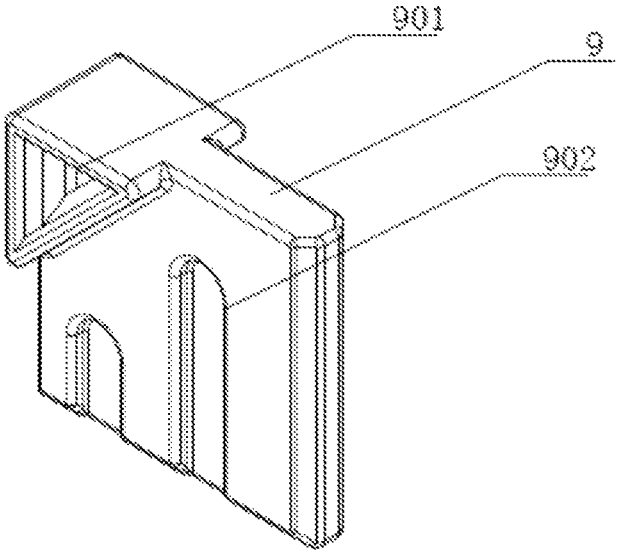
FIG. 11 is a structural schematic diagram of the fifth plug connector in the present invention.

As shown in FIG. 11, the fifth plug connector 9 comprises two annular bulges 901 and four strip-shaped grooves 902 on the front plane and the back plane, wherein the annular bulges 901 are positioned on the corner of the upper end of the fifth plug connector 9, and the strip-shaped grooves 902 positioned in the lower end of the fifth plug connector 9 are symmetric front and back, respectively.

Figure 12:
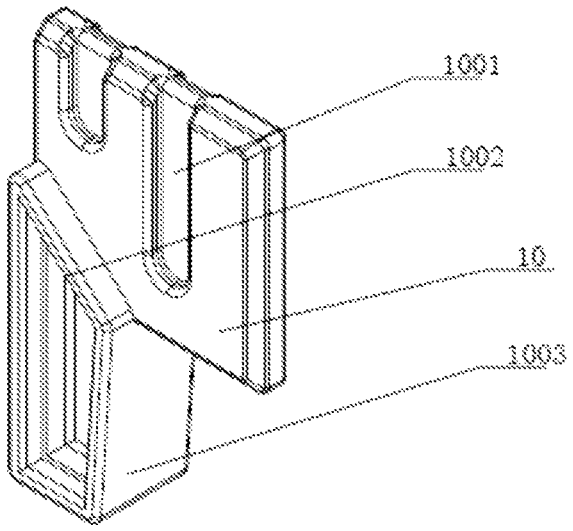
FIG. 12 is a structural schematic diagram of the sixth plug connector in the present invention.
Figure 13:
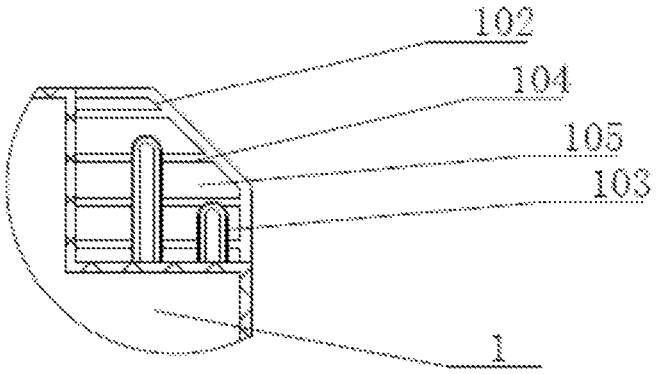
FIG. 13 is an enlarged schematic diagram of a part A in FIG. 2.

As shown in FIG. 12, the sixth plug connector 10 comprises two annular bulges 1002 and four strip-shaped grooves 1001 on the front plane and the back plane, wherein the annular bulges 1002 are positioned on the corner of the bottom end of the sixth plug connector 10, and the strip-shaped grooves 1001 in the upper end of the sixth plug connector 10 are symmetric front and back, respectively. The support upright 1003 is also arranged on the lower end of the sixth plug connector 10 and is configured to support the corresponding presentation board module 1. Furthermore, the support upright 1003 at the lower end of the sixth plug connector 10 can also be changed into the roller structure.

Figure 14:
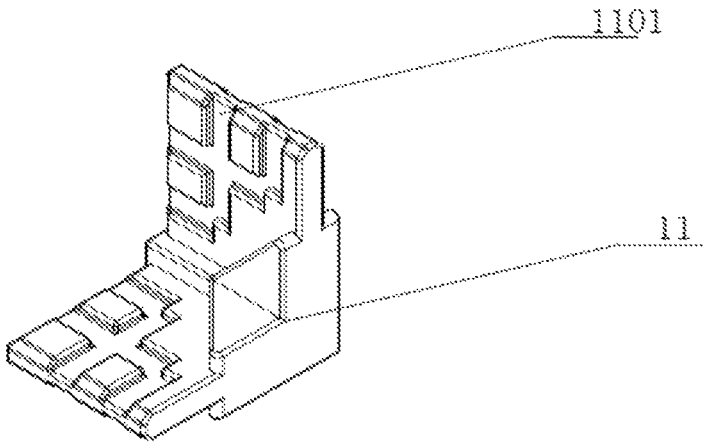
FIG. 14 is a structural schematic diagram of the seventh plug connector in the present invention.

As shown in FIG. 14, the seventh plug connector 11 is of an L-shaped structure, wherein two horizontal and vertical strip-shaped grooves 1101 are respectively formed in two ends of the L-shaped structure in two vertical directions, the horizontal strip-shaped grooves or the vertical strip-shaped grooves are configured for horizontal or vertical installation of multiple presentation board modules 1, and the strip-shaped grooves 1101 in the front plane and the back plane are mutually symmetric.

Figure 15:
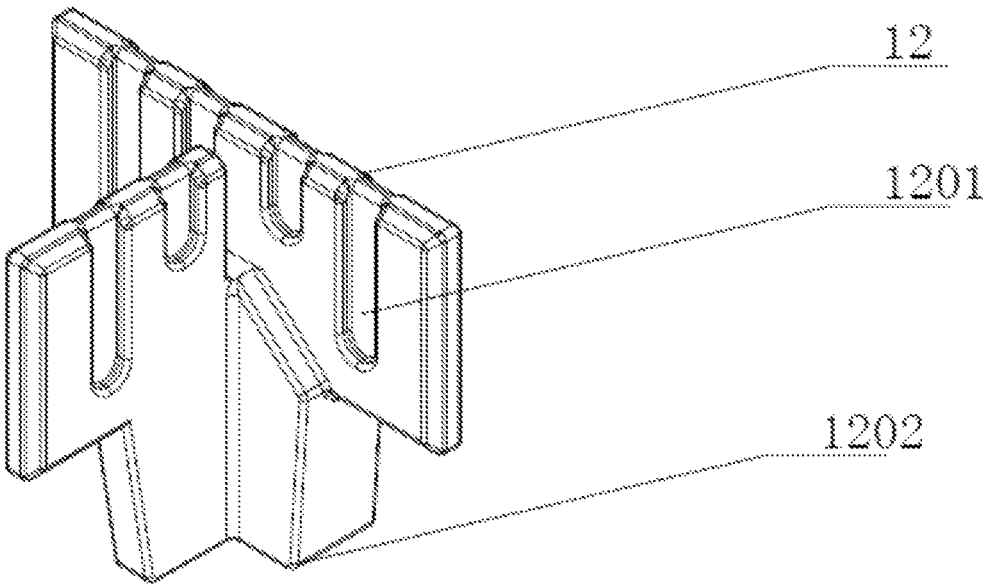
FIG. 15 is a structural schematic diagram of the eighth plug connector in the present invention.

As shown in FIG. 15, the eighth plug connector 12 is of a T-shaped structure, wherein two strip-shaped grooves 1201 are respectively configured in three ends of the T-shaped structure, and the strip-shaped grooves 1201 in the front plane and the back plane of each end of the T-shaped structure of the eighth plug connector 12 are mutually symmetric. The support upright 1202 is also arranged at the lower end of the eighth plug connector 12 and is configured to support the corresponding presentation board module 1. Furthermore, the support upright 1202 at the lower end of the eighth plug connector 12 can also be changed into the roller structure.

Figure 16:
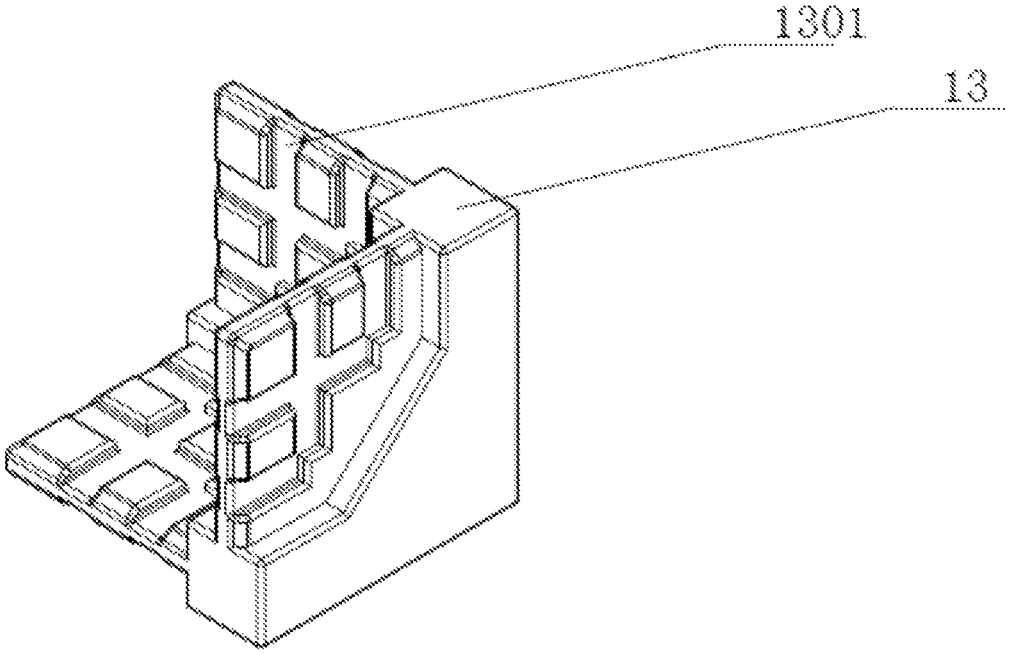
FIG. 16 is a structural schematic diagram of the ninth plug connector in the present invention.

As shown in FIG. 16, the ninth plug connector 13 is of a triplanar intersection body structure, wherein two horizontal and vertical strip-shaped grooves 1301 are formed in three end surfaces, respectively, in the vertical direction, the horizontal strip-shaped grooves or the vertical strip-shaped grooves are respectively configured for horizontal or vertical installation of multiple presentation board modules 1, and the strip-shaped grooves 1301 in the front plane and the back plane of each end of the ninth plug connector 13 are mutually symmetric.

Figure 17:
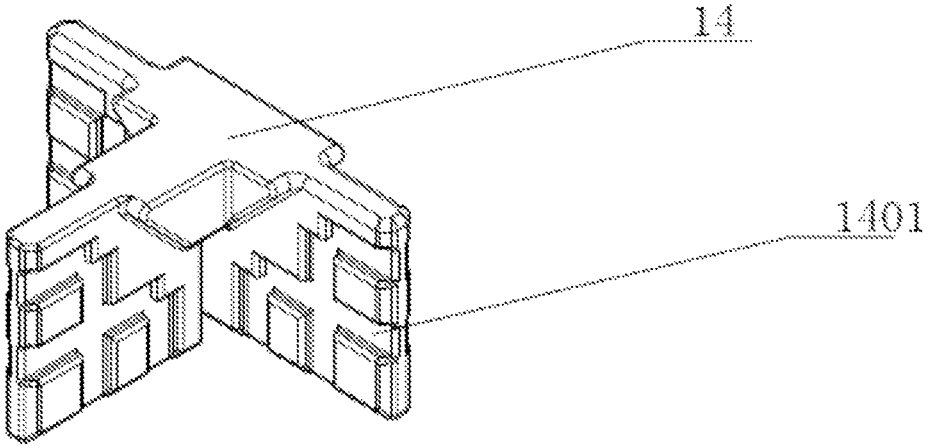
FIG. 17 is a structural schematic diagram of the tenth plug connector in the present invention.

As shown in FIG. 17, the tenth plug connector 14 is of a T-shaped structure, wherein two horizontal and vertical strip-shaped grooves 1401 are respectively formed in three ends of the T-shaped structure in the vertical direction, the transverse strip-shaped grooves or the vertical strip-shaped grooves are respectively configured for horizontal or vertical installation of multiple presentation board modules 1, and the strip-shaped grooves 1401 in the front plane and the back plane of each end of the T-shaped structure of the tenth plug connector 14 are mutually symmetric.

Figure 18:
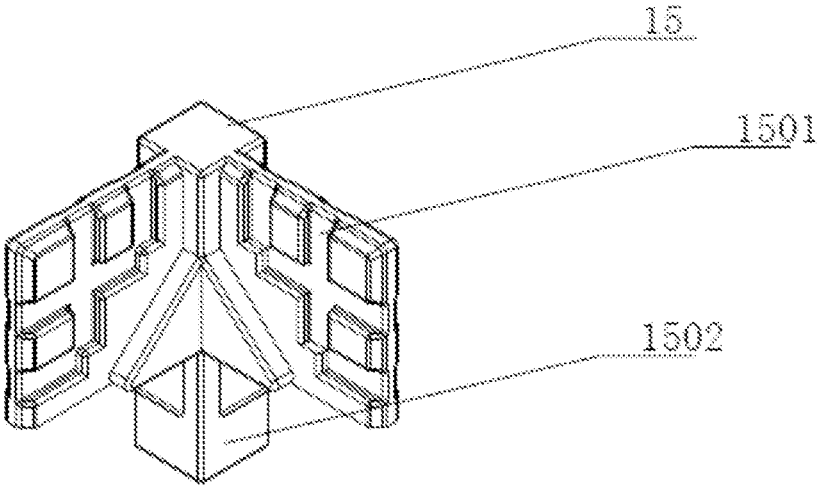
FIG. 18 is a structural schematic diagram of the eleventh plug connector in the present invention.

As shown in FIG. 18, the eleventh plug connector 15 is of a L-shaped structure, wherein two horizontal and vertical strip-shaped grooves 1501 are formed in two ends of the L-shaped structure, respectively, in the vertical direction, the horizontal strip-shaped grooves or the vertical strip-shaped grooves are respectively configured for horizontal or vertical installation of multiple presentation board modules 1, and the strip-shaped grooves 1501 in the front plane and the back plane of each end of the L-shaped structure of the eleventh plug connector 15 are mutually symmetric; the support upright 1502 is also arranged at the lower end of the eleventh plug connector 15 and is configured to support the corresponding presentation board module 1. Furthermore, the support upright 1502 at the lower end of the third plug connector 5 can also be changed into the roller structure.

Figure 19:
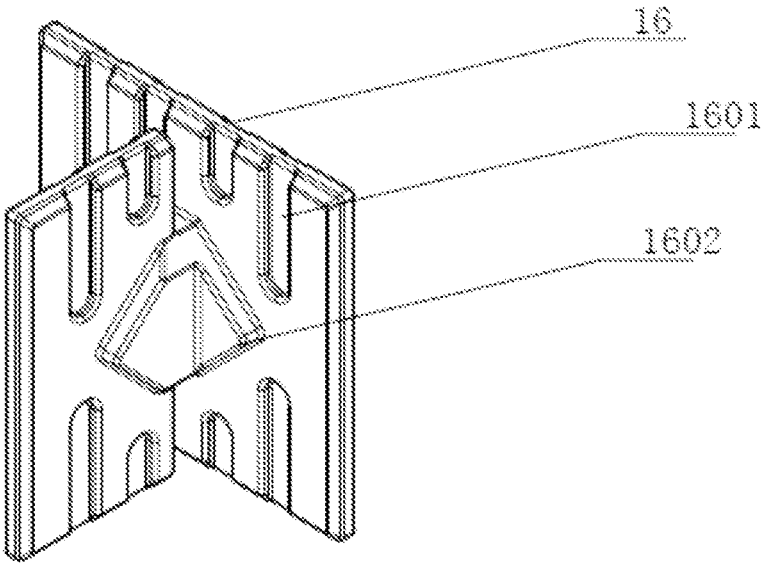
FIG. 19 is a structural schematic diagram of the twelfth plug connector in the present invention.

As shown in FIG. 19, the twelfth plug connector 16 is of a T-shaped structure, wherein four strip-shaped grooves 1601 are configured in three ends of the T-shaped structure, respectively, in the vertical direction, and the strip-shaped grooves 1601 in the front plane and the back plane of each end of the T-shaped structure of the twelfth plug connector 16 are mutually symmetric.

Figure 20:
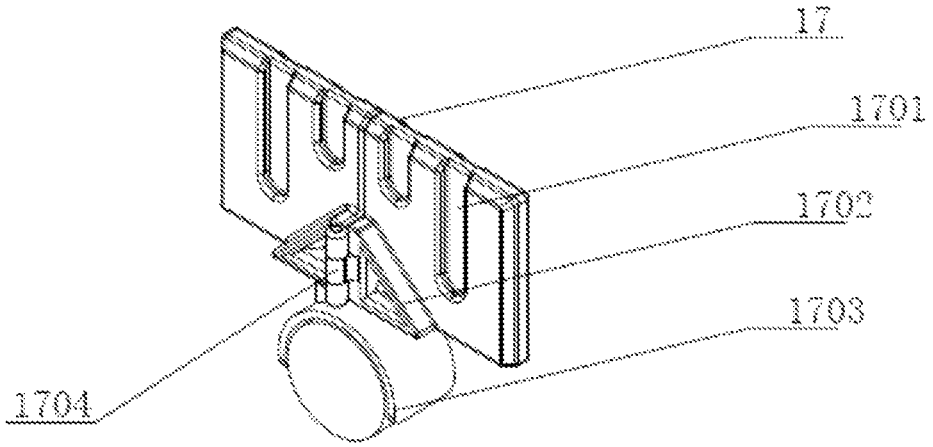
FIG. 20 is a structural schematic diagram that the support upright in the middle of the lower end of the third articulation piece is changed into the roller in the present invention.

As shown in FIG. 20, the third articulation piece 7 is one of extended variant products and has the difference residing in that the support upright at the lower end of the third articulation piece 7 is changed into a roller 1703; in the same way, the support uprights at the bottom ends of the third plug connector 5, the sixth plug connector 10, the eighth plug connector 12 and the eleventh plug connector 15 can also be changed into the roller structure, respectively, and thus the presentation board can locally or integrally move after being mounted.

Figure 21:
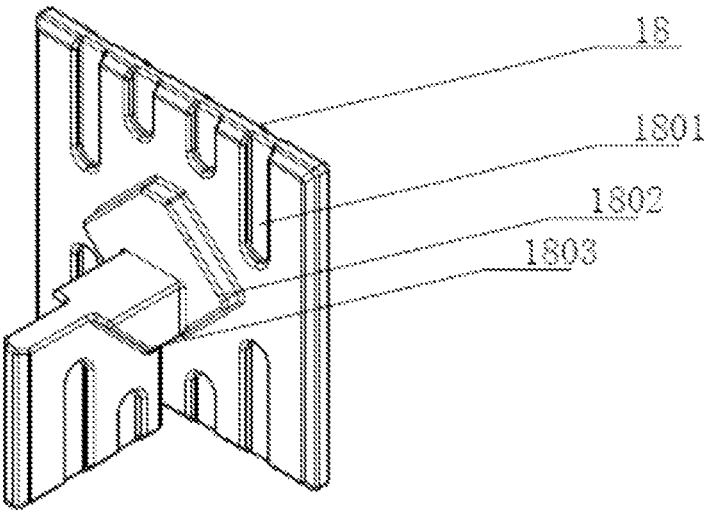
FIG. 21 is a structural schematic diagram of the thirteen plug connector in the present invention.

As shown in FIG. 21, the thirteenth plug connector 18 is formed by integrally fixing a left connecting surface and a right connecting surface, wherein the annular bulge 1803 is arranged on the top of the left connecting surface and is fixed with the annular bulge 1802 in the middle of the right connecting surface into a whole; two strip-shaped grooves 1801 are formed in the bottom end of the left connecting surface and are symmetric mutually in the front plane and the back plane; eight strip-shaped grooves 1801 are formed in the upper end and the lower end of the right connecting surface, respectively and are symmetric mutually in the front plane and the back plane.

The hinge is arranged in each of the annular bulges on the articulation pieces (3, 6 and 7), extends to the upper end surface and the lower end surface of the articulation piece and is configured to realize connection between every two presentation board modules 1 at any angle.

Figure 5:
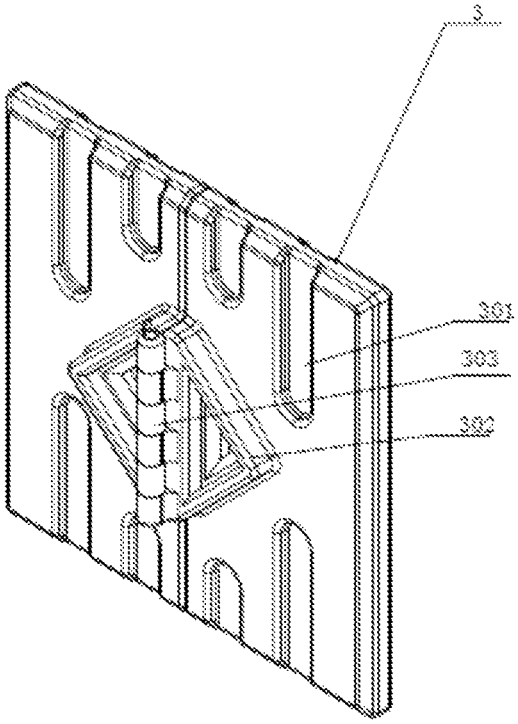
FIG. 5 is a structural schematic diagram of the first articulation piece in the present invention.

As shown in FIG. 5, the first articulation piece 3 comprises two annular bulges 302, the hinge 303 and eight strip-shaped grooves 301, wherein the hinge 303 is positioned between the two annular bulges 302 and extends to the upper end surface and the lower end surface of the first articulation piece 3; the strip-shaped grooves 301 in the front surface and the back surface, the upper surface and the lower surface as well as the left surface and the right surface are mutually symmetric, respectively.

Figure 7:
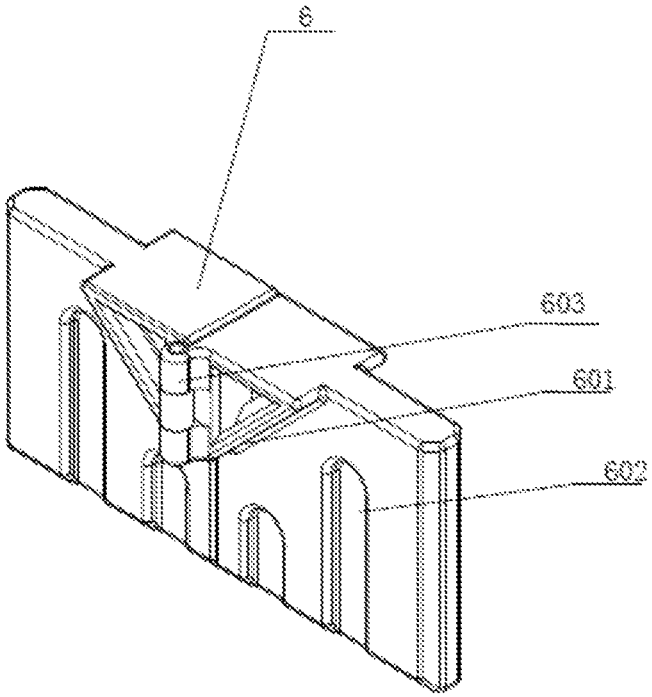
FIG. 7 is a structural schematic diagram of the second articulation piece of the present invention.

As shown in FIG. 7, the second articulation piece 6 comprises two annular bulges 601, the hinge 603 and four strip-shaped grooves 602, wherein the hinge 603 is positioned between the two annular bulges 601 and extends to the upper end surface and the lower end surface of the second articulation piece 6; the strip-shaped grooves 602 in the front surface and the back surface as well as the left surface and the right surface are mutually symmetric, respectively.

Figure 9:
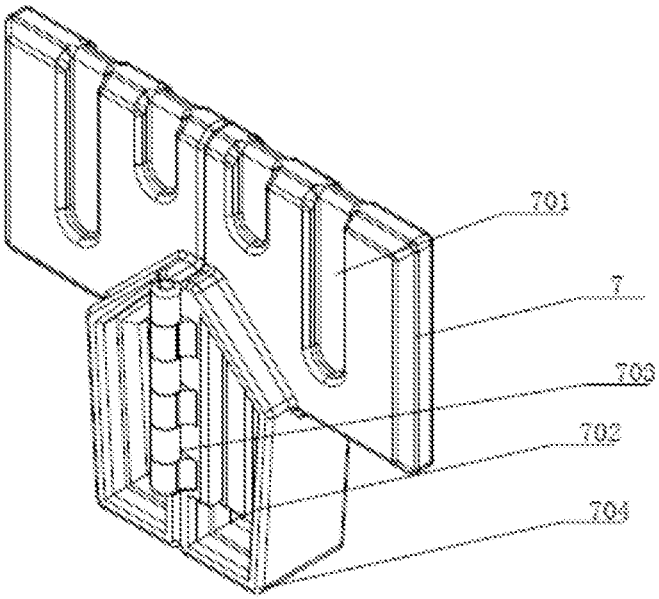
FIG. 9 is a structural schematic diagram of the third articulation piece in the present invention.

As shown in FIG. 9, the third articulation piece 7 comprises two annular bulges 702, the hinge 703 and four annular bulges 601, wherein the hinge 703 is positioned between the two annular bulges 702 and extends to the upper end surface and the lower end surface of the third articulation piece 7; the strip-shaped grooves 701 in the front surface and the back surface as well as the left surface and the right surface are symmetric mutually; the support upright 704 is arranged at the lower end of the third articulation piece 7 and is configured to support the corresponding presentation board module 1. Furthermore, the support upright 704 at the lower end of the third articulation piece 7 can also be changed into the roller structure.

Figure 3:
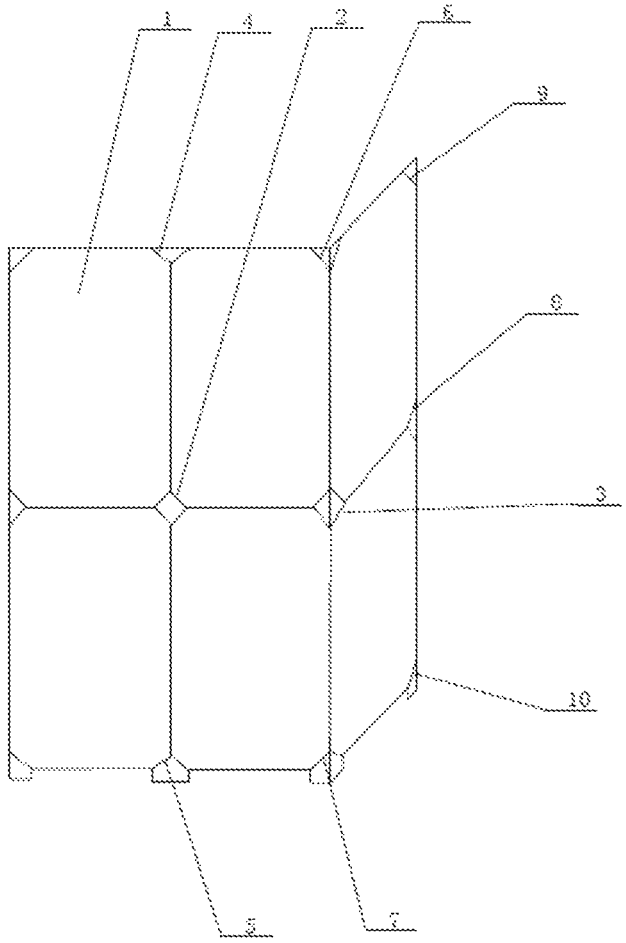
FIG. 3 is a structural assembly schematic diagram of the present invention.

As shown in FIG. 3, the structural assembly schematic diagram is a L-shaped planar structure schematic diagram after six presentation board modules 1 (three upper presentation board modules 1 and three lower presentation board modules 1) are mutually connected, wherein the three upper presentation board modules 1 are connected with the lower three presentation board modules 1 through the first plug connector 2, the first articulation piece 3 and the fourth plug connector 8, respectively. The tops of the upper three presentation board modules 1 are connected through the second plug connector 4, the second articulation piece 6 and the fifth plug connector 9, respectively. The bottoms of the lower three presentation board modules 1 are connected through the third plug connector 5, the third articulation piece 7 and the sixth plug connector 10, respectively, and the support uprights or roller structures on the lower ends of the third plug connector 5, the third articulation piece 7 and the sixth plug connector 10 are configured to support the modularized presentation board consisting of the six presentation board modules 1.

Figure 22:
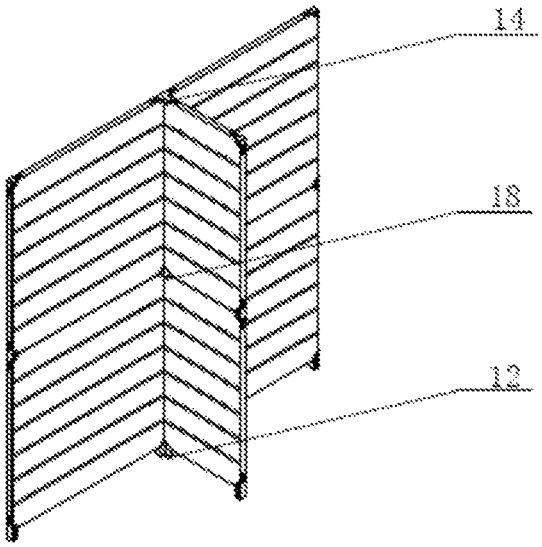
FIG. 22 is a T-shaped assembly schematic diagram of the present invention.

As shown in FIG. 22, the six presentation board modules 1 are mutually connected to form a schematic diagram of the presentation board representing a T-shaped stereoscopic structure, and the tenth plug connector 14, the thirteenth plug connector 16 and the eighth plug connector 12 are applied to the connecting center lines of the six presentation board modules 1 for fixed connection.

Figure 23:
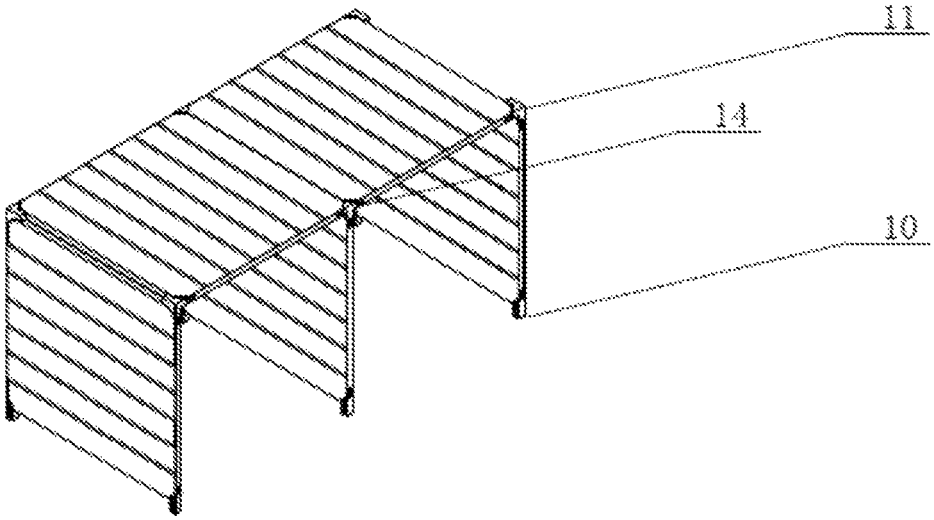
FIG. 23 is an assembly schematic diagram of an open desk structure of the present invention.

As shown in FIG. 23, six sixth plug connectors 10, four seventh plug connectors 11 and two tenth plug connectors 14 are applied to the five presentation board modules 1 for connection to form an open desk structure.

Figure 24:
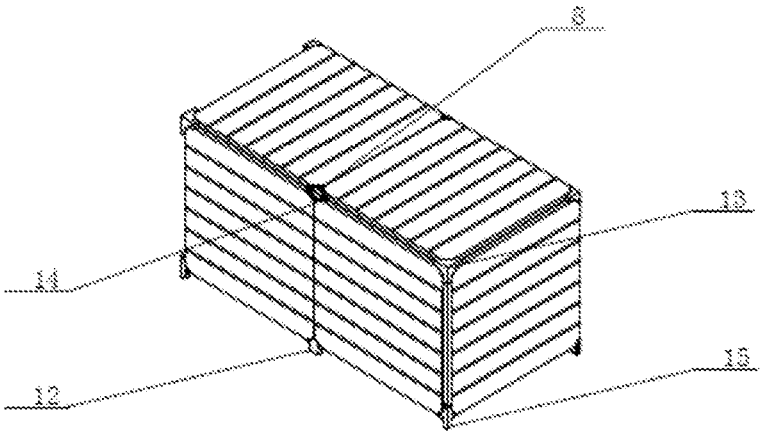
FIG. 24 is an assembly schematic diagram of a closed desk structure of the present invention.

As shown in FIG. 24, four eleventh plug connectors 15, two eighth plug connectors 12, two tenth plug connectors 14, two fourth plug connectors 8 and four ninth plug connectors 13 are applied to eight presentation board modules 1 for connection to form a closed desk structure.

Figure 25:
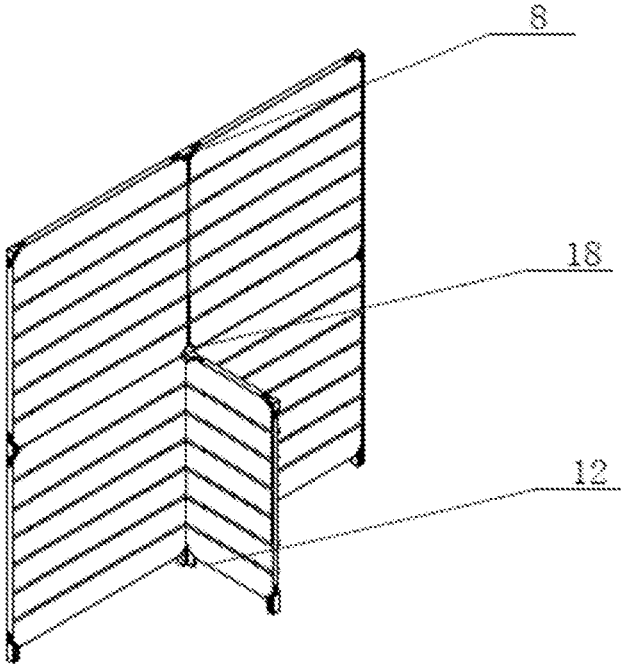
FIG. 25 is a structural assembly schematic diagram of another T-shaped presentation board of the present invention.

As shown in FIG. 25, one fourth plug connector 8, one thirteenth plug connector 18 and one eighth plug connector 12 are applied to five presentation board modules 1 for connection to form an assembled structure of another T-shaped presentation board.

As stated above, the embodiments above-mentioned are just described to illuminate the technical conception and characteristic of the present invention, its aim is to ensure that those skilled in the art should recognize the content of the present invention and implement it, but not to limit the protection scope of the present invention, and both equivalent changes and variations, made without departing from the sprit of the present invention fall into the protection scope of the present invention.

The invention claimed is:

1. A modularized presentation board having an improved structure, comprising:

multiple presentation board modules (1), multiple plug connectors and multiple articulation pieces and characterized in that the presentation board modules (1) are rectangular and 45-degree chamfer structures are arranged on four corners of each presentation board module (1);

a clamping slot (102) is configured in the middle of each of four corners in the thickness direction, multiple strip-shaped bulges (103) and multiple reinforced ribs (104) perpendicular to the strip-shaped bulges (103) are arranged on both sides of each clamping slot (102), respectively, and a groove (105) is defined between every two adjacent reinforced ribs (104);

the plug connectors and the articulation pieces are equipped with multiple annular bulges, respectively, and multiple strip-shaped grooves are symmetrically formed in the upper side and the lower side and/or the left side and the right side of each plug connector;

the strip-shaped grooves and the strip-shaped bulges (103) on the clamping slots of the presentation board modules are mutually nested and matched, and therefore the nested and matched connection between every two adjacent presentation board modules is realized.

2. A modularized presentation board according to claim 1, wherein said plug connectors include a first plug connector (2), a second plug connector (4), a third plug connector (5), a fourth plug connector (8), a fifth plug connector (9), a sixth plug connector (10), a seventh plug connector (11), an eighth plug connector (12), a ninth plug connector (13), a tenth plug connector (14), an eleventh plug connector (15), a twelfth plug connector (16) and a thirteenth plug connector (18); and the articulation pieces include a first articulation piece (3), a second articulation piece (6) and a third articulation piece (7).

3. A modularized presentation board according to claim 2, wherein a symmetric annular bulge and two or four strip-shaped grooves symmetric up and down are respectively configured on the front plane and the back plane of each of the flat plug connectors and articulation pieces, and the annular bulges on the mutually symmetric planes of each plug connector are symmetric to each other, which is conductive to manual operation of workers to the plug connectors.

4. A modularized presentation board according to claim 3, wherein hinges are arranged in the annular bulges on each articulation piece, extend to the upper end surface and the lower end surface of the articulation piece and are configured to realize mutual connection between every two presentation board modules at any angle.

5. A modularized presentation board according to claim 4, wherein a support upright or roller is also arranged in the middle of the lower part of each of the third plug connector (5), the sixth plug connector (10), the eighth plug connector (12), the eleventh plug connector (15) and the third articulation piece (7), so that the presentation board can locally or integrally move after being mounted.

6. A modularized presentation board according to claim 5, wherein multiple mutually parallel strip-shaped elongated slots (101) are formed in each rectangular presentation board module (1).

7. A modularized presentation board according to claim 6, wherein horizontal and vertical symmetric strip-shaped grooves are formed in each of the seventh plug connector (11), the ninth plug connector (13), the tenth plug connector (14) and the eleventh plug connector (15) and configured to realize assembly of the presentation board modules (1) in any direction.

* * * * *